US005848682A

United States Patent [19]

Schuster et al.

[11] Patent Number: 5,848,682

[45] Date of Patent: Dec. 15, 1998

[54] SORTING INSTALLATION, IN PARTICULAR FOR MAIL

[75] Inventors: Rudolf Schuster, Kirchheim; Rudolf Brugger, Puchheim; Wilfried Lange, Garching; Volkmar Schulz, Schwarzenbruck; Werner von Hacht, Uttenreuth; Adolf Höpler, München, all of Germany

[73] Assignee: Siemens Aktiengesellschaft, Munich, Germany

[21] Appl. No.: 581,522

[22] PCT Filed: Jul. 7, 1994

[86] PCT No.: PCT/DE94/00782

§ 371 Date: Jan. 11, 1996

§ 102(e) Date: Jan. 11, 1996

[87] PCT Pub. No.: WO95/02468

PCT Pub. Date: Jan. 26, 1995

[30] Foreign Application Priority Data

Jul. 14, 1993 [DE] Germany ..... 43 23 565.4

[51] Int. Cl.[6] ..... B07C 3/08

[52] U.S. Cl. ..... 198/370.05; 198/370.03

[58] Field of Search ..... 198/704, 370.05, 198/370.03, 838, 845, 778

[56] References Cited

U.S. PATENT DOCUMENTS

| | | | |
|---|---|---|---|
| 2,818,965 | 1/1958 | Hörth | 198/838 X |
| 3,300,026 | 1/1967 | Lens et al. | 198/704 |
| 3,550,751 | 12/1970 | Jack, Jr. | 198/370.05 X |
| 3,589,498 | 6/1971 | Cowan et al. | 198/370.05 X |
| 3,845,853 | 11/1974 | Wahren | 198/778 X |
| 4,310,276 | 1/1982 | Castagnoli | 198/367.1 |
| 4,688,678 | 8/1987 | Zue et al. | 198/704 X |
| 5,361,888 | 11/1994 | Brown et al. | 198/778 X |

FOREIGN PATENT DOCUMENTS 2454338 11/1980 France .

*Primary Examiner*—David A. Bucci
*Attorney, Agent, or Firm*—Hill & Simpson

[57] ABSTRACT

A sorting installation comprises a plurality of conveyed item carriers, circulating on at least one conveying mechanism, for receiving, transporting and controllably delivering the conveyed items. The conveyed item carriers are fastened by pairs on circulating transport carriages of the conveying mechanism. The transport carriages are guided by rollers on two profiles aligned at a vertical distance in relation to each other and extending in the transporting direction. The transport carriages are driven by an endlessly circulating transporting, cable. The conveying mechanism according to the invention forms, with little constructional complexity, a reliable transporting system by which the conveyed items can also be transferred to sorting containers arranged on different levels.

7 Claims, 4 Drawing Sheets

SORTING INSTALLATION, IN PARTICULAR FOR MAIL

RELATED APPLICATION

The present application is related to copending application U.S. Ser. No. 03/531,521 filed Feb. 15, 1996 entitled "SORTING INSTALLATION, IN PARTICULAR FOR MAIL", Schuster et al, inventors.

BACKGROUND OF THE INVENTION

The machine-readable postal code numbers to be given on items of mail, such as letters, postcards, parcels and the like, as a code number for a location, a delivery area, a post office box or a major recipient make it possible for the mail to be distributed at high speed by machine. The sorting of the incoming items of mail is performed in this case with the aid of controllable conveyed item carriers, which are loaded with in each case one item of mail manually or by machine at specific loading points and then deliver this item of mail to a sorting container, or a corresponding pigeonhole, assigned to the respective postal code number. Since, for reasons of saving space, there is the wish to arrange both the loading points and the sorting containers or pigeonholes on different levels, the conveyed item carriers circulating on conveying mechanisms must possibly also be able to provide a link between different heights. After the transfer of the item of mail to the assigned sorting container or the assigned pigeonhole, the empty conveyed item container can again be loaded with an item of mail when it passes a loading point.

FR-A-24 54 338 corresponding to U.S. Pat. No. 4,310,276 discloses a sorting installation for mail which has a plurality of conveyed item carriers, circulating on a conveying mechanism, for receiving, transporting and controllably delivering the mail. The conveyed item carriers are in this case fastened in pairs opposite one another to circulating transport cars of the conveying mechanism. The transport cars, which are driven for example by an endless chain, are guided by rollers on a rail which is vertically aligned and extends in the transporting direction. In the region of two U-shaped deflecting means of the conveying mechanism lying next to each other, the transport cars are taken along a total of four parallel double rows with sorting containers, into which the mail can be discharged from the conveyed item carriers. A circulation of the transport cars suspended from the rails on two or more levels could be realized only with difficulty due to the great overall height of the suspended cars.

U.S. Pat. No. 3 300 026 discloses a sorting installation for mail which has conveyed item carriers circulating in pairs on a conveying mechanism for receiving, transporting and controllably delivering the mail. The conveying mechanism comprises two endlessly circulating chains which are at a distance from each other, are guided in a meandering form by means of corresponding rollers and guide the conveyed item carriers on a number of levels lying one above the other, along in each case a row with sorting containers. The meandering path of the conveying mechanism on a number of levels results in a relatively large overall height of the sorting installation, with correspondingly poor accessibility of the sorting containers arranged on the upper levels.

SUMMARY OF THE INVENTION

It is an object of the invention to provide a sorting installation of which the transporting mechanism is of a simple construction and permits reliable transport of the conveyed item carriers between the loading point and the sorting containers or pigeonholes assigned to the respective conveyed item. The transporting mechanism is at the same time to be able in particular to provide a link between different heights, again with little complexity.

Apart from the sorting and distributing of mail in public post offices or the in-house post centers of large companies, a sorting installation according to the invention can also be used, for example, in warehouse systems or automatic order-picking systems for comparable tasks, in which products or parts provided with codings are delivered to sorting containers or pigeonholes assigned to the respective codings.

The advantages achieved by the invention are, in particular, that the transport carriages form simple and robust transporting means for the conveyed item carriers, it being possible for the guiding and driving of the transport carriages to be realized with minimal structural complexity by means of two profiles extending in the transporting direction and an endlessly circulating transport cable. The circulation of the transport carriages on at least two levels makes it possible with the same area for setting up the overall sorting installation for example to double the sorting containers available for the sorting tasks. In this case, on each level the transport carrier is taken along in each case in two parallel rows with sorting containers. The U-shaped deflecting means and height-overcoming deflecting means required for this purpose can in this case be realized particularly simply by the roller guidance of the transport carriages on two profiles and by the driving by means of endlessly circulating transporting means.

If on a transport carriage according to the invention there are fastened at least two conveyed item carriers, this results in further reduction in the constructional complexity of the overall conveying mechanism.

In a further development of the invention, the conveyed item carriers are open at an end side opposite the transport carriages to permit a lateral loading of the conveyed item carriers, thereby allowing particularly low overall heights of the sorting installation to be realized.

If, according to another development of the invention the profiles are of a tubular design, the outlay for material for the conveying mechanism can be further reduced, while at the same time reducing the weight.

In a further development of the invention the two profiles for guiding rollers of the transport carriages are connected to each other at straight sections by cross-pieces, which permits a robust and reliable arrangement of the two profiles in the straight-running sections of the conveying mechanism, so that it is possible to dispense with additional fastening means for the profiles in the curved and deflecting regions of the conveying mechanism.

In another development of the invention the endlessly circulating transporting system has a transport cable which permits reliable and quiet driving of the transport carriages with little complexity.

An exemplary embodiment of the invention is described in more detail below and is represented in the drawings.

DESCRIPTION OF THE PREFERRED EMBODIMENTS

Figure 1:
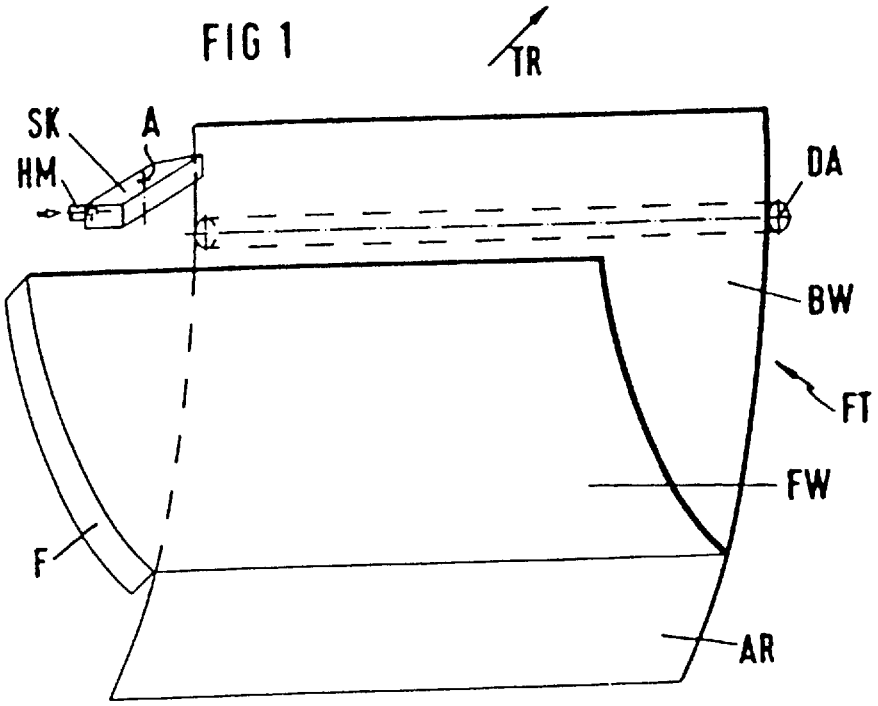
FIG. 1 shows in perspective representation a conveyed item carrier comprising a fixedly arranged wall part and a movably arranged wall part.

FIG. 1 shows in perspective representation a conveyed item carrier, which is denoted overall by FT and comprises a fixedly arranged wall part FW and a movable wall part BW. The movable wall part BW is in this case able to swivel about a pivot axis DA aligned transversely with respect to the transporting direction TR of the conveyed item carrier FT.

Figure 2:
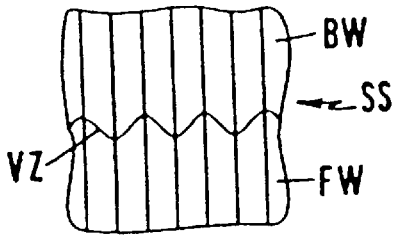
FIG. 2 shows the toothing of the two wall parts represented in FIG. 1, in the closed position of the conveyed item carrier.

FIG. 1 shows the closed position of the conveyed item carrier FT, in which the fixedly arranged wall part FT and the movably arranged wall part BW, which are both curved outward in each case, form a cross-sectionally approximately V-shaped receiving pocket for the conveyed item. According to FIG. 2, the two wall parts FW and BW are in each case bent in a corrugated form, the two wall parts FW and BW intermeshing with a toothing VZ in the closed position SS represented in a plan view from above. According to FIG. 1, the securement of the closed position SS takes place by a catch SK, which can be turned about an axis denoted by A and can be released by actuation of a solenoid HM. If the catch SK is released, the movable wall part BW is swiveled about the pivot axis DA such that a downwardly open delivery slot of the conveyed item carrier FT is formed. The lower extension of the movably arranged wall part BW in this case forms a delivery chute AR, which adjoins this delivery slot in the downward direction and slopes counter to the transporting direction TR.

Figure 3:
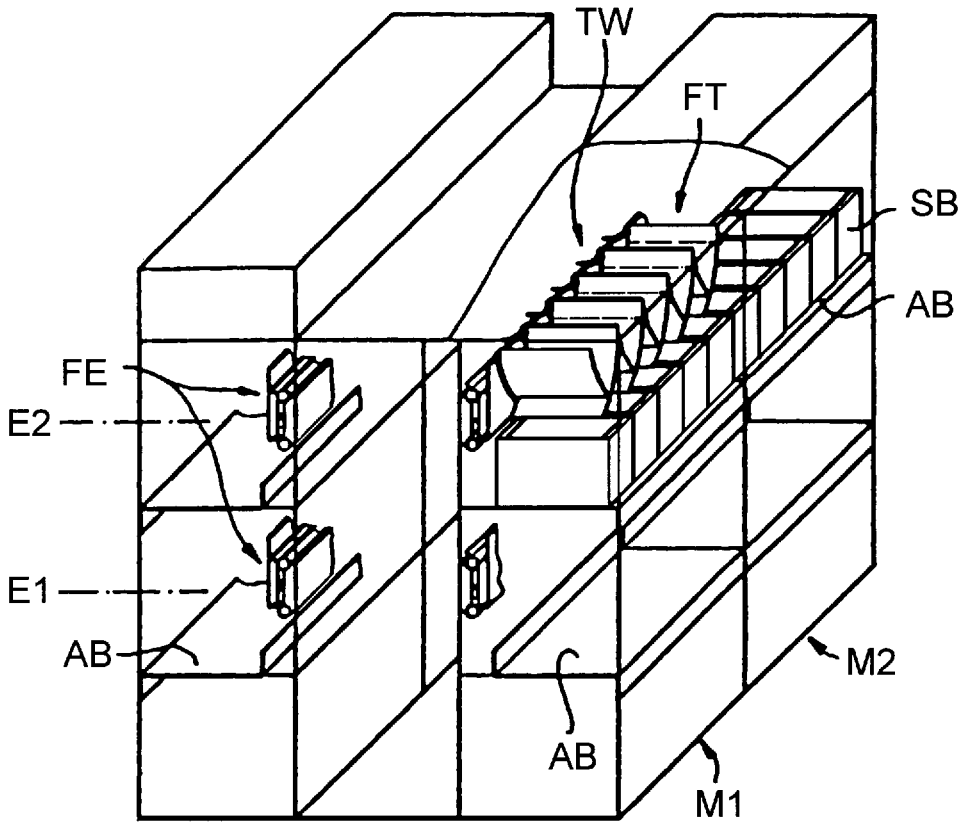
FIG. 3 shows a perspective representation of two modules, arranged in series, of a sorting installation equipped with conveyed item carriers according to FIG. 1.

FIG. 3 shows a perspective representation of two modules M1 and M2, arranged in series, of a sorting installation equipped with conveyed item carriers FT according to FIG. 1. Here there are in each case a total of five conveyed item carriers FT fitted on a transport carriage TW, which is a component part of a conveying mechanism FE and circulates on two levels E1 and E2. Each module M1 and M2 has on each level E1 and E2 in each case two support plates AB, onto which sorting containers SB can be placed in series closely next to one another. It can be seen that the conveyed item carriers FT on the transport carriages TW circulate over the sorting containers SB in such a way that, upon the actuation of the catch SK (compare FIG. 1), the conveyed item, not represented in any more detail in FIG. 3, can be dropped into a sorting container SB assigned to the respective coding.

Figure 4:
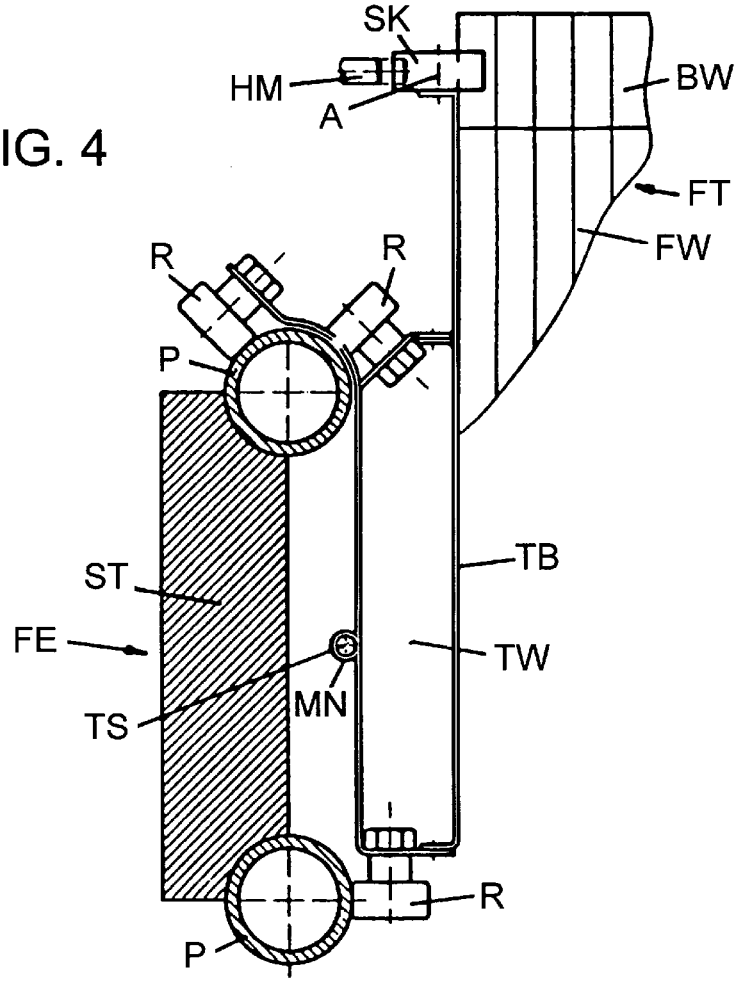
FIG. 4 shows the operating principle of the conveying mechanism used in the sorting installation according to FIG. 2.

FIG. 4 shows more details of the conveying mechanism FE represented in FIG. 3. In the cross section represented here, it can be seen that the transport carriage TW is guided by means of rollers, denoted by R, on two tubular profiles P, extending in the transporting direction TR (compare FIG. 1). The profiles P, aligned parallel to each other a vertical distance apart, are in this case connected to each other in straight-running regions of the conveying mechanism FE by means of cross-pieces ST, likewise extending in the transporting direction TR, whereas these cross-pieces ST are dispensed with in the curved regions. The driving of a transport carriage TW takes place by means of an endlessly circulating transport cable TS, to which the transport carriage TW is fastened with the aid of a driver MN. On the side opposite the transport cable TS, the transport carriage TW has a carrying plate TB, on which the individual conveyed item carriers FT are fastened at the end face and which also bears the catches SK and the assigned solenoids HM. The carrying plate TB in this case acts as a securing means for the pivot axes DA of the movable wall parts BW, while the fixed wall parts FW of the individual conveyed item carriers FT are fixedly connected to the carrying plate TB by means of flanges F on the end face (compare FIG. 1).

Figure 5:
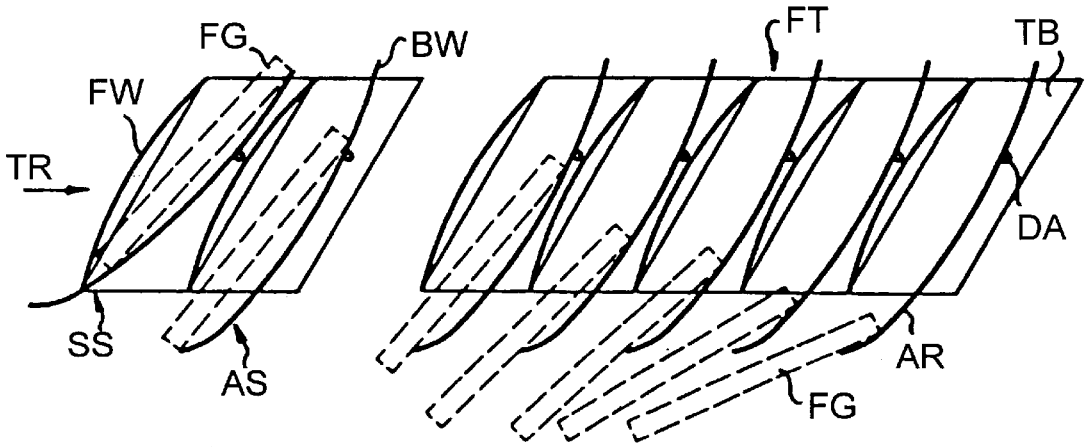
FIG. 5 shows a study of the sequence of movements of the conveyed item when dropping from a conveyed item carrier according to FIG. 1.

FIG. 5 shows a study of the time-independent sequence of movements when dropping the conveyed item from the conveyed item carriers FT-according to the invention. On the left-hand side of the representation shown here, a conveyed item carrier FT can be seen in its closed position SS. The conveyed item FG, represented by dashed lines, is intended here to be a thin letter.

The second conveyed item carrier FT, seen from the left, is represented already in its delivery position AS, in which, by a pivoting about the pivot axis DA, the movable wall part BW forms together with the fixedly arranged wall part FW a delivery slot for the conveyed item FG. It can be seen from the following positions of the conveyed item FG that the latter slides downward over the delivery chute AR and as it does so receives in addition to the downwardly directed vertical component of motion a horizontal component of motion opposed to the transporting direction TR. In this case, the transporting speed in the transporting direction TR and the inclination of the delivery chute AR can be adapted to each other such that the conveyed item FG can fall at least largely vertically downward into an assigned sorting container SB (compare FIG. 3).

Figure 6:
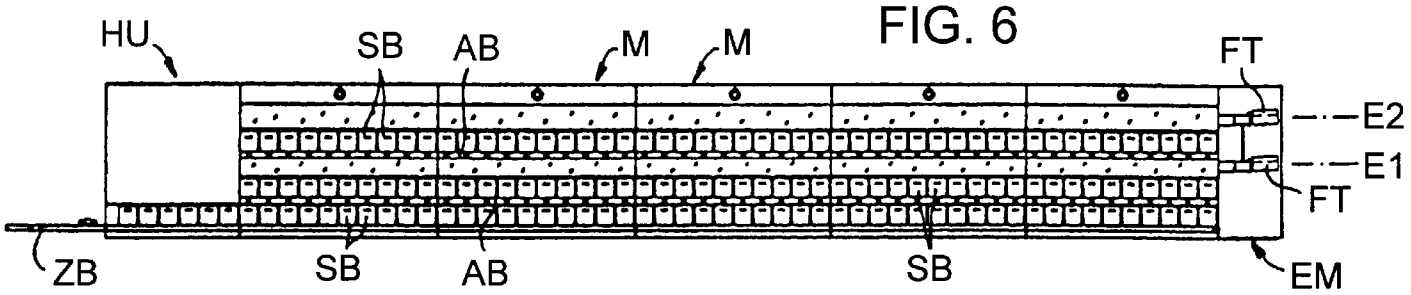
FIG. 6 shows a side view of a sorting installation constructed from modules according to FIG. 3.
Figure 7:
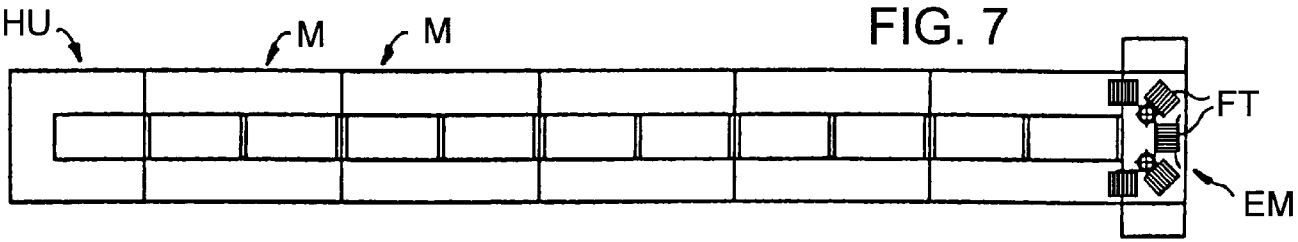
FIG. 7 shows a plan view of the sorting installation according to FIG. 6.

FIGS. 6 and 7 show a sorting installation made up of individual modules M in side view and in plan view, respectively. The individual modules M correspond in this case to the modules M1 and M2 represented in FIG. 3, there also being shown, however, in FIG. 6 an additional feeding belt ZB, arranged underneath the lower level E1, for the provision of empty sorting containers SB. When a full sorting container SB is removed from the level E1 or the level E2, it can be replaced by an empty sorting container SB provided on the feeding belt ZB.

In the case of the representation according to FIGS. 6 and 7, there is on the left-hand side in front of the first module M a height-overcoming deflecting means HU, while on the right-hand side there adjoins the last module M a loading module EM at the end face. It can be seen that, in the region of this loading module EM, the individual conveyed item carriers FT can be loaded from the rear side, from the end face, or from the front side, it being possible for the loading to be performed manually or by machine.

Figure 8:
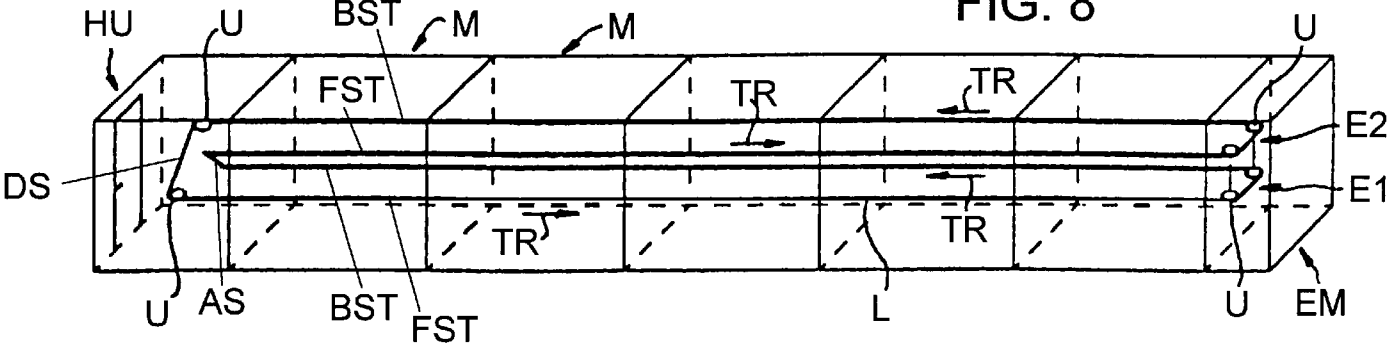
FIG. 8 shows a perspective representation of the guidance of the conveying mechanism of the sorting installation represented in FIGS. 6 and 7, over two levels.

FIG. 8 shows in a greatly simplified schematic representation the routing of the conveying mechanism FE (compare FIGS. 3 and 4) over the two levels E1 and E2. The line L in this case shows the spatial path of the transport cable TS (compare FIG. 4), the transporting direction being indicated by arrows TR. The guidance of the transport cable TS in the region of the height-overcoming deflecting means HU and in the region of the loading module EM is in this case indicated by deflecting rollers U. The corresponding spatial path of the profiles P (compare FIG. 4), taken parallel to the line L, cannot be seen in FIG. 3.

In the upper level E2 and in the lower level E1, the conveyor means FE (FIG. 3) forms a respective front sorting track FST and a back sorting track BST. The height overcoming deflection means HU comprises an obliquely downwardly inclined section DS and an obliquely ascending section AS of the conveying path. The downwardly inclined section DS proceeds between two deflection rollers U from the back sorting track BST of the upper level E2 to the front sorting track FST of the lower level E1. The ascending section AS proceeds from the back sorting track BST of the lower level E1 to the front sorting track FST of the upper level E2.

The conveyed item carriers FT, loaded with conveyed items FG for example in a rearward loading zone of the lower level E1 (compare FIG. 7), are deflected forward on the same level in the region of the end face of the loading module EM and then transported past the sorting containers SB arranged on the front side on the lower support plate AB. In the region of the height-overcoming deflecting means HU, the conveyed item carriers FT are then taken obliquely upward onto the upper level E2 and there they are transported past the sorting containers SB arranged on the rear side on the upper support plate AB. In the region of the loading module EM, the conveyed item carriers FT are then deflected forward on the same level and are then transported past the sorting containers SB arranged on the front side on the upper support plate AB. In the region of the height-overcoming deflecting means HU, the conveyed item carriers FT are then taken obliquely downward onto the lower level E1 and there they are transported past the sorting containers SB arranged on the rear side on the lower support plate AB. On the transporting path described above, the individual conveyed item carriers FT deliver the taken-along conveyed item FG to an assigned sorting container SB, so that they can then be loaded again with conveyed items FG when passing the rear loading zone.

Although various minor changes and modifications might be proposed by those skilled in the art, it will be understood that our wish is to include within the claims of the patent warranted hereon all such changes and modifications as reasonably come within our contribution to the art.

What is claimed is:

1. A mail sorting installation, comprising:

a plurality of conveyed item carriers circulating on at least one conveying mechanism for receiving, transporting and controllably delivering conveyed items to assigned sorting containers;

the conveyed item carriers being fastened on circulating transport carriages of the conveying mechanism;

the transport carriages being guided by rollers on two profiles aligned at a vertical distance in relation to each other and extending in a transporting direction;

the transport carriages being driven by an endlessly circulating transporting system;

the transport carriages circulating on at least an upper level and a lower level via at least one height-overcoming deflecting mechanism, a circulating region for the carriages on the lower level lying directly underneath a circulating region for the carriages on the upper level; and on each level the transport carriages being taken along two parallel rows with sorting containers by a front sorting track and a back sorting track.

2. The sorting installation according to claim 1 wherein on at least one of the transport carriages there are fastened at least two conveyed item carriers.

3. The sorting installation according to claim 1 wherein the conveyed item carriers are open on an end side opposite the transport carriages.

4. The sorting installation according to claim 1 wherein the profiles are of a tubular design.

5. The sorting installation according to claim 1 wherein the two profiles are connected to each other in a region of straight-running sections of the conveying mechanism by cross-pieces extending in the transporting direction.

6. The sorting installation according to claim 1 wherein the endlessly circulating transporting system has a transport cable.

7. A mail sorting installation, comprising:

a plurality of conveyed item carriers circulating on at least one conveying mechanism for receiving, transporting and controllably delivering conveyed mail to assigned mail sorting containers;

the conveyed item carriers being fastened on circulating transport carriages of the conveying mechanism;

the transport carriages being guided by rollers on two profiles spaced from each other and extending in a transporting direction;

the transport carriages being driven by an endlessly circulating transporting system;

the transport carriages circulating on at least two vertically spaced upper and lower levels via at least one height-changing deflecting mechanism, a circulating region for the carriages on the lower level lying directly underneath a circulating region for the carriages on the upper level;

on each level the transport carriages being taken along a row with sorting containers; and front and back sorting tracks being provided in both the upper level and the lower level and wherein the lower level front sorting track lies directly underneath the upper level front sorting track and the lower level back sorting track lies directly underneath the upper level back sorting track.

* * * * *